US011490481B2

(12) United States Patent
Chang et al.

(10) Patent No.: US 11,490,481 B2
(45) Date of Patent: Nov. 1, 2022

(54) PULSE WIDTH MODULATION DRIVER AND OPERATION METHOD THEREOF

(71) Applicant: Novatek Microelectronics Corp., Hsinchu (TW)

(72) Inventors: Jen-Chung Chang, Hsinchu (TW); Yi-Nung Hu, Kaohsiung (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/218,068

(22) Filed: Mar. 30, 2021

(65) Prior Publication Data

US 2022/0322509 A1 Oct. 6, 2022

(51) Int. Cl.
*H05B 45/325* (2020.01)

(52) U.S. Cl.
CPC ..... *H05B 45/325* (2020.01)

(58) Field of Classification Search
CPC ..... H05B 45/30; H05B 45/32; H05B 45/325; H03L 7/00; H03L 7/08; H03L 7/091; H03K 5/00; H03K 5/133
See application file for complete search history.

(56) References Cited

U.S. PATENT DOCUMENTS 10,541,869 B2 * 1/2020 Zhang ..... H04L 41/0893
2011/0267387 A1 * 11/2011 Baik ..... G09G 3/3406 345/76
2017/0027034 A1 * 1/2017 Nozawa ..... H05B 45/38
2021/0112641 A1 * 4/2021 Li ..... H05B 45/325

* cited by examiner

*Primary Examiner* — Thai Pham
(74) *Attorney, Agent, or Firm* — JCIPRNET

(57) ABSTRACT

A pulse width modulation (PWM) driver and an operation method thereof are provided. The PWM driver includes a PWM generating circuit and multiple driving channels. The PWM generating circuit generates multiple PWM signals. The driving channels drive multiple light emitting elements of a light emitting element array. Each of the driving channels includes a PWM selection circuit. The PWM selection circuits are coupled to the PWM generating circuit to receive the PWM signals. Each of the PWM selection circuits selects a PWM signal from the PWM signals according to corresponding sub-pixel data. The selected PWM signal is output to at least one corresponding light emitting element among the light emitting elements.

14 Claims, 8 Drawing Sheets

PULSE WIDTH MODULATION DRIVER AND OPERATION METHOD THEREOF

BACKGROUND

Technical Field

The disclosure relates to a light emitting equipment, and in particular to a pulse width modulation (PWM) driver and an operation method thereof.

Description of Related Art

The light emitting element of the light emitting equipment is driven by current. The average current flowing through the light emitting element per unit time may determine the brightness of the light emitting element. Pulse width modulation (PWM) may be applied to the drive current of the light emitting element. By adjusting the pulse width of the drive current, the average current flowing through the light emitting element may be adjusted. The general light emitting element driver uses a PWM generating circuit to convert sub-pixel data into a PWM drive current. The existing PWM generating circuit uses a counter, a comparator, and a logic gate to convert the sub-pixel data into corresponding PWM pulses (the PWM drive current). Complex circuits such as the counter and the comparator have high power consumption. In addition, the existing PWM circuit requires a high frequency clock to generate the PWM pulses with sufficient resolution to avoid glitch. The circuit running on the high-frequency clock consume higher power.

Multiple light emitting elements form a light emitting element array. Each light emitting element (or multiple light emitting elements located in the same column) is driven by a corresponding PWM generating circuit. As the number of light emitting elements in the light emitting element array (or the number of columns in the light emitting element array) increases, the number of PWM generating circuits must also increase (that is, increasing the number of complex circuits such as the counter and the comparator).

It should be noted that the content of the "Description of Related Art" section is used to help understand the disclosure. Part of the content (or all of the content) disclosed in the "Description of Related Art" section may not be the conventional technology known to persons skilled in the art. The content disclosed in the "Description of Related Art" section does not represent that the content is already known to persons skilled in the art before the application of the disclosure.

SUMMARY

The disclosure provides a pulse width modulation (PWM) driver and an operation method thereof to reduce the number of PWM generating circuits.

In an embodiment of the disclosure, the PWM driver includes a first PWM generating circuit and multiple first driving channels. The first PWM generating circuit is configured to generate multiple first PWM signals. The first driving channels are configured to drive multiple first light emitting elements of a light emitting element array. Each of the first driving channels includes a first PWM selection circuit. The first PWM selection circuits are coupled to the first PWM generating circuit to receive the first PWM signals. Each of the first PWM selection circuits selects a PWM signal (a first selected PWM signal) from the first PWM signals according to corresponding sub-pixel data. The first selected PWM signal is output to at least one corresponding light emitting element among the first light emitting elements.

In an embodiment of the disclosure, the operation method includes the following steps. Multiple first PWM signals are generated by a first PWM generating circuit. A PWM signal (a first selected PWM signal) is selected from the first PWM signals according to corresponding sub-pixel data by a first PWM selection circuit of each of multiple first driving channels. The first selected PWM signal is output to at least one corresponding light emitting element among multiple first light emitting elements of a light emitting element array, so that the first driving channels drive the first light emitting elements of the light emitting element array.

Based on the above, the PWM driver described in the embodiments of the disclosure uses a PWM generating circuit to supply the same group of PWM signals to multiple driving channels. According to the corresponding sub-pixel data, the PWM selection circuit of each driving channel may select a PWM signal from multiple PWM signals of the group of PWM signals, and then output the selected PWM signal to one or more corresponding light emitting elements. By sharing the PWM generating circuit in multiple driving channels, the number of PWM generating circuits may be reduced.

In order for the features and advantages of the disclosure to be more comprehensible, specific embodiments are described in detail below in conjunction with the accompanying drawings.

DETAILED DESCRIPTION OF DISCLOSED EMBODIMENTS

Figure 1:
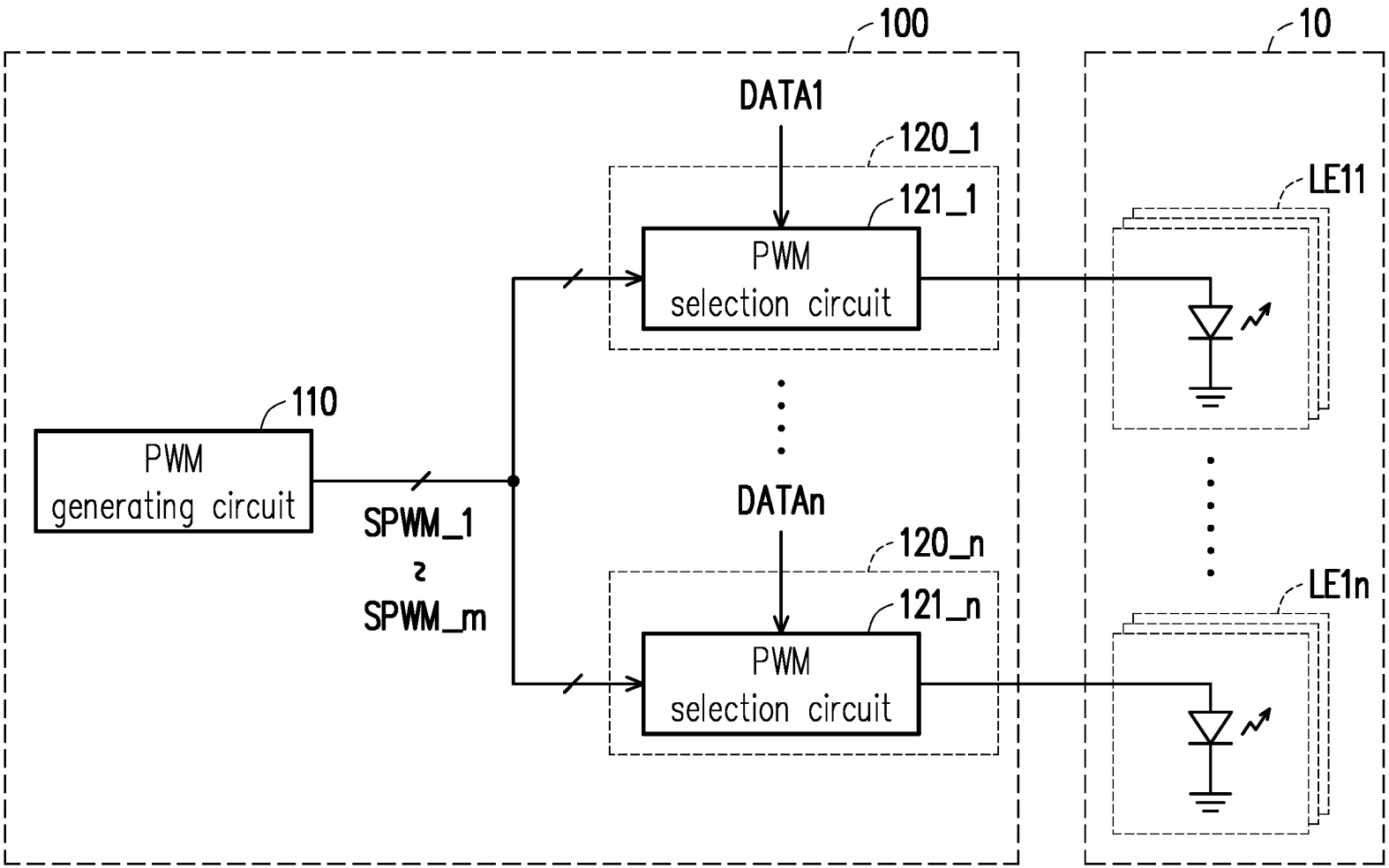
FIG. 1 is a schematic diagram of a circuit block of a pulse width modulation (PWM) driver according to an embodiment of the disclosure.

The term "coupling (or connection)" used in the entire specification (including the claims) of the present application may refer to any direct or indirect connection means. For example, if a first device is described as being coupled (or connected) to a second device, it should be interpreted that the first device may be directly connected to the second device or the first device may be indirectly connected to the second device through another device or certain connection means. Terms such as "first" and "second" mentioned in the entire specification (including the claims) of the present application are used to name the elements or to distinguish between different embodiments or ranges, but not to limit the upper limit or lower limit of the number of elements or to limit the sequence of the elements. In addition, wherever possible, elements/components/steps using the same reference numerals in the drawings and embodiments represent the same or similar parts. Related descriptions in different embodiments may be made with reference to each other for the elements/components/steps using the same reference numerals or using the same terminologies.

FIG. 1 is a schematic diagram of a circuit block of a pulse width modulation (PWM) driver 100 according to an embodiment of the disclosure. The PWM driver 100 is suitable for driving multiple light emitting elements (for example, light emitting elements LE11 to LE1*n* shown in FIG. 1) of a light emitting element array 10. According to actual design, each of the light emitting elements LE11 to LE1*n* may include a light emitting diode (LED) or other light emitting elements. The PWM driver 100 shown in FIG. 1 includes a PWM generating circuit 110 and multiple driving channels 120_1 to 120_*n*.

Figure 2:
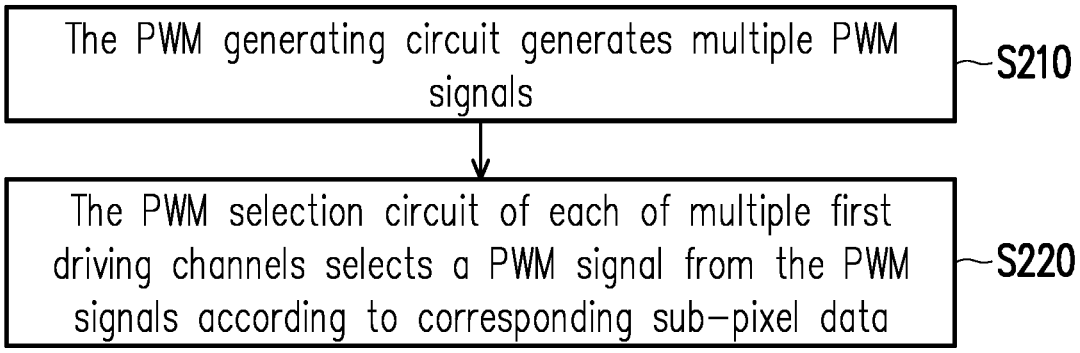
FIG. 2 is a schematic diagram of a flowchart of an operation method of a PWM driver according to an embodiment of the disclosure.

FIG. 2 is a schematic diagram of a flowchart of an operation method of a PWM driver according to an embodiment of the disclosure. Please refer to FIG. 1 and FIG. 2. In Step S210, the PWM generating circuit 110 may generate multiple PWM signals SPWM_1 to SPWM_m to the driving channels 120_1 to 120_*n*. A number m of the PWM signals SPWM_1 to SPWM_m is less than a number n of the driving channels 120_1 to 120_*n*. The PWM generating circuit 110 may determine the pulse width and the phase of each of the PWM signals SPWM_1 to SPWM_m according to actual design and application.

Figure 3:
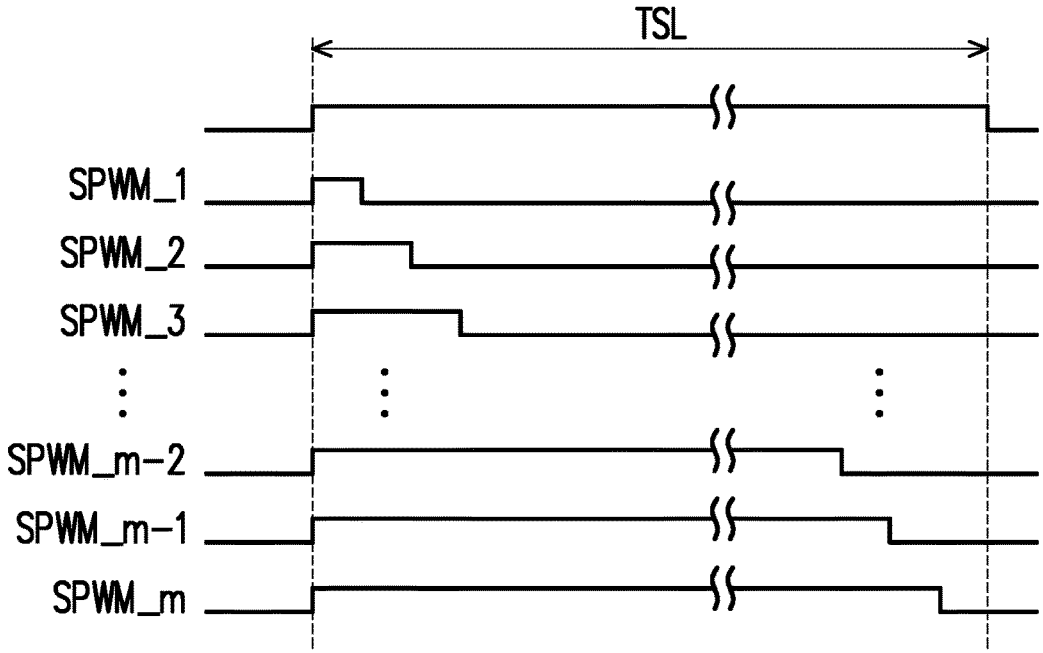
FIG. 3 is a schematic diagram of waveforms of PWM signals shown in FIG. 1 according to an embodiment of the disclosure.

For example, FIG. 3 is a schematic diagram of waveforms of PWM signals SPWM_1 to SPWM_m shown in FIG. 1 according to an embodiment of the disclosure. The horizontal axis of FIG. 3 represents time, where the graphical symbol "TSL" represents a scanning line period of the light emitting element array 10. For the PWM signals SPWM_1 to SPWM_m shown in FIG. 1, reference may be made to the related description of the PWM signals SPWM_1, SPWM_2, SPWM_3, . . . , SPWM_m−2, SPWM_m−1, and SPWM_m shown in FIG. 3. Please refer to FIG. 1 and FIG. 3. According to actual design and application, during the scanning line period TSL shown in FIG. 3, the PWM signals SPWM_1 to SPWM_m output by the PWM generating circuit 110 may have the same phase but different pulse widths.

Figure 4:
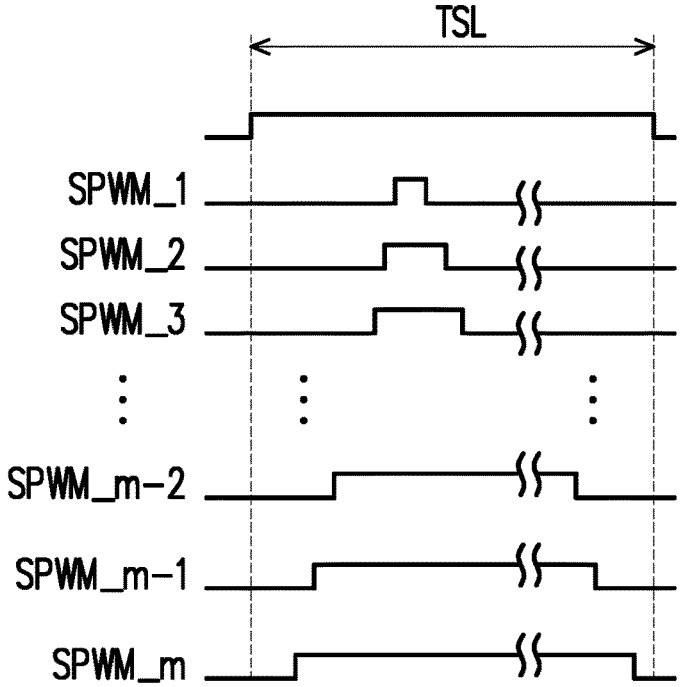
FIG. 4 is a schematic diagram of waveforms of the PWM signals shown in FIG. 1 according to another embodiment of the disclosure.

FIG. 4 is a schematic diagram of waveforms of the PWM signals SPWM_1 to SPWM_m shown in FIG. 1 according to another embodiment of the disclosure. The horizontal axis of FIG. 4 represents time. For the PWM signals SPWM_1 to SPWM_m shown in FIG. 1, reference may be made to the related description of the PWM signals SPWM_1, SPWM_2, SPWM_3, . . . , SPWM_m−2, SPWM_m−1, and SPWM_m shown in FIG. 4. Please refer to FIG. 1 and FIG. 4. According to actual design and application, during the scanning line period TSL shown in FIG. 4, the PWM signals SPWM_1 to SPWM_m output by the PWM generating circuit 110 may have different phases and different pulse widths.

Figure 5:
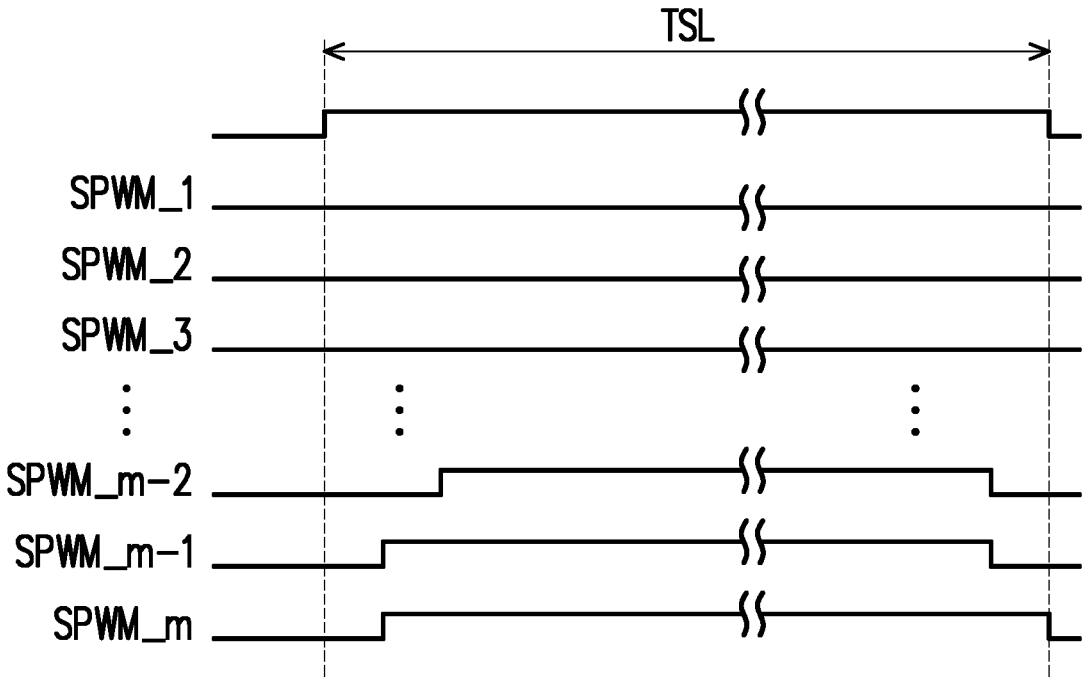
FIG. 5 is a schematic diagram of waveforms of the PWM signals shown in FIG. 1 according to yet another embodiment of the disclosure.

FIG. 5 is a schematic diagram of waveforms of the PWM signals SPWM_1 to SPWM_m shown in FIG. 1 according to yet another embodiment of the disclosure. The horizontal axis of FIG. 5 represents time. For the PWM signals SPWM_1 to SPWM_m shown in FIG. 1, reference may be made to the related description of the PWM signals SPWM_1, SPWM_2, SPWM_3, . . . , SPWM_m−2, SPWM_m−1, and SPWM_m shown in FIG. 5. Please refer to FIG. 1 and FIG. 5. According to actual design and application, during the scanning line period TSL shown in FIG. 5, a part of the PWM signals SPWM_1 to SPWM_m output by the PWM generating circuit 110 have the same phase. For example, the PWM signals SPWM_m−1 and SPWM_m have the same phase. Another part of the PWM signals SPWM_1 to SPWM_m have different phases. For example, the PWM signals SPWM_m−2 and SPWM_m−1 have different phases. A part of the PWM signals SPWM_1 to SPWM_m have different pulse widths. For example, the PWM signals SPWM_m−2, SPWM_m−1, and SPWM_m have different pulse widths. Another part of the PWM signals SPWM_1 to SPWM_m have the same pulse width. For example, the pulse widths of the PWM signals SPWM_1, SPWM_2, and SPWM_3 are all 0.

Please refer to FIG. 1 and FIG. 2. The driving channels 120_1 to 120_*n* may drive the light emitting element LE11 to LE1*n* of the light emitting element array 10. Each of the driving channels 120_1 to 120_*n* includes a PWM selection circuit, such as PWM selection circuits 121_1 to 121_*n*. Each of the PWM selection circuits 121_1 to 121_*n* is coupled to the PWM generating circuit 110 to receive the PWM signals SPWM_1 to SPWM_m. In Step S220, each of the PWM selection circuits 121_1 to 121_*n* selects a PWM signal from the PWM signals SPWM_1 to SPWM_m according to corresponding sub-pixel data, and outputs the selected PWM signal to at least one corresponding light emitting element among the light emitting elements LE11 to LE1*n*. For example, the PWM selection circuit 121_1 selects a PWM signal from the PWM signals SPWM_1 to SPWM_m according to sub-pixel data DATA1, such as selecting the PWM signal SPWM_m, and outputs the selected PWM signal SPWM_m to the light emitting element LE11. The PWM selection circuit 121_*n* may select a PWM signal from the PWM signals SPWM_1 to SPWM_m according to sub-pixel data DATAn, and output the selected PWM signal to the light emitting element LE1*n*.

In summary, the PWM driver 100 described in the above embodiments uses one PWM generating circuit 110 to supply the same group of PWM signals to the driving channels 120_1 to 120_*n*. According to the corresponding sub-pixel data, the PWM selection circuit 121_1 to 121_*n* of each of the driving channels 120_1 to 120_*n* may select a PWM signal from the PWM signals SPWM_1 to SPWM_m of the group of PWM signals, and then output the selected PWM signal to one or more corresponding light emitting elements. By sharing the PWM generating circuit 110 in the driving channels 120_1 to 120_*n*, the number of the PWM generating circuit 110 may be reduced.

Figure 6:
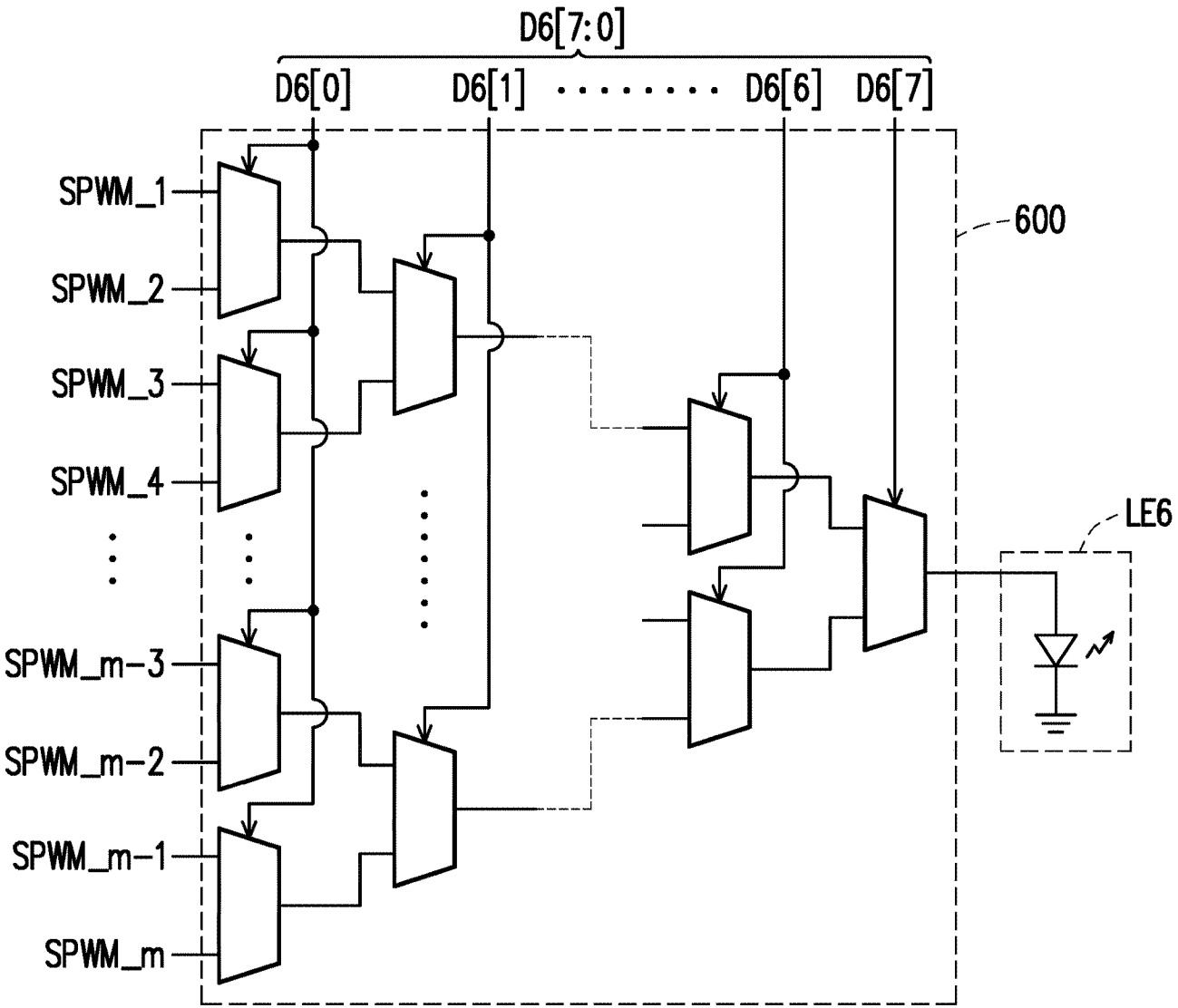
FIG. 6 is a schematic diagram of a circuit block of a PWM selection circuit according to an embodiment of the disclosure.

FIG. 6 is a schematic diagram of a circuit block of a PWM selection circuit 600 according to an embodiment of the disclosure. The PWM selection circuit 600 shown in FIG. 6 may be coupled to the PWM generating circuit 110 to receive the PWM signals SPWM_1, SPWM_2, SPWM_3, SPWM_4, . . . , SPWM_m−3, SPWM_m−2, SPWM_m−1, and SPWM_m. The PWM selection circuit 600 shown in FIG. 6 may serve as an implementation example of any one of the PWM selection circuits 121_1 to 121_*n* shown in FIG. 1. That is, any one of the PWM selection circuits 121_1 to 121_*n* shown in FIG. 1 may be deduced by referring to the related description of the PWM selection circuit 600 shown in FIG. 6, and/or for the PWM selection circuit 600 shown in FIG. 6, reference may be made to the related description of any one of the PWM selection circuits 121_1 to **121_*n* shown in FIG. 1. Sub-pixel data D6[7:0] shown in FIG. 6 may be regarded as any one of the sub-pixel data DATA1 to DATAn shown in FIG. 1. Here, it is assumed that the sub-pixel data D6[7:0] shown in FIG. 6** is 8-bit data, but the bit number of the sub-pixel data may be determined according to actual design.

The PWM selection circuit 600 shown in FIG. 6 includes multiple multiplexers. Bits D6[7], D6[6], . . . , D6[1], and D6[0] of the sub-pixel data D6[7:0] may control the multiplexers, as shown in FIG. 6. The multiplexers are controlled by the corresponding sub-pixel data D6[7:0] to select a PWM signal from the PWM signals SPWM_1 to SPWM_m, and the multiplexers output the selected PWM signal to at least one corresponding light emitting element LE6. The light emitting element LE6 shown in FIG. 6 may be regarded as any one of the light emitting elements LE11 to LE**1*n* shown in FIG. 1**.

Figure 7:
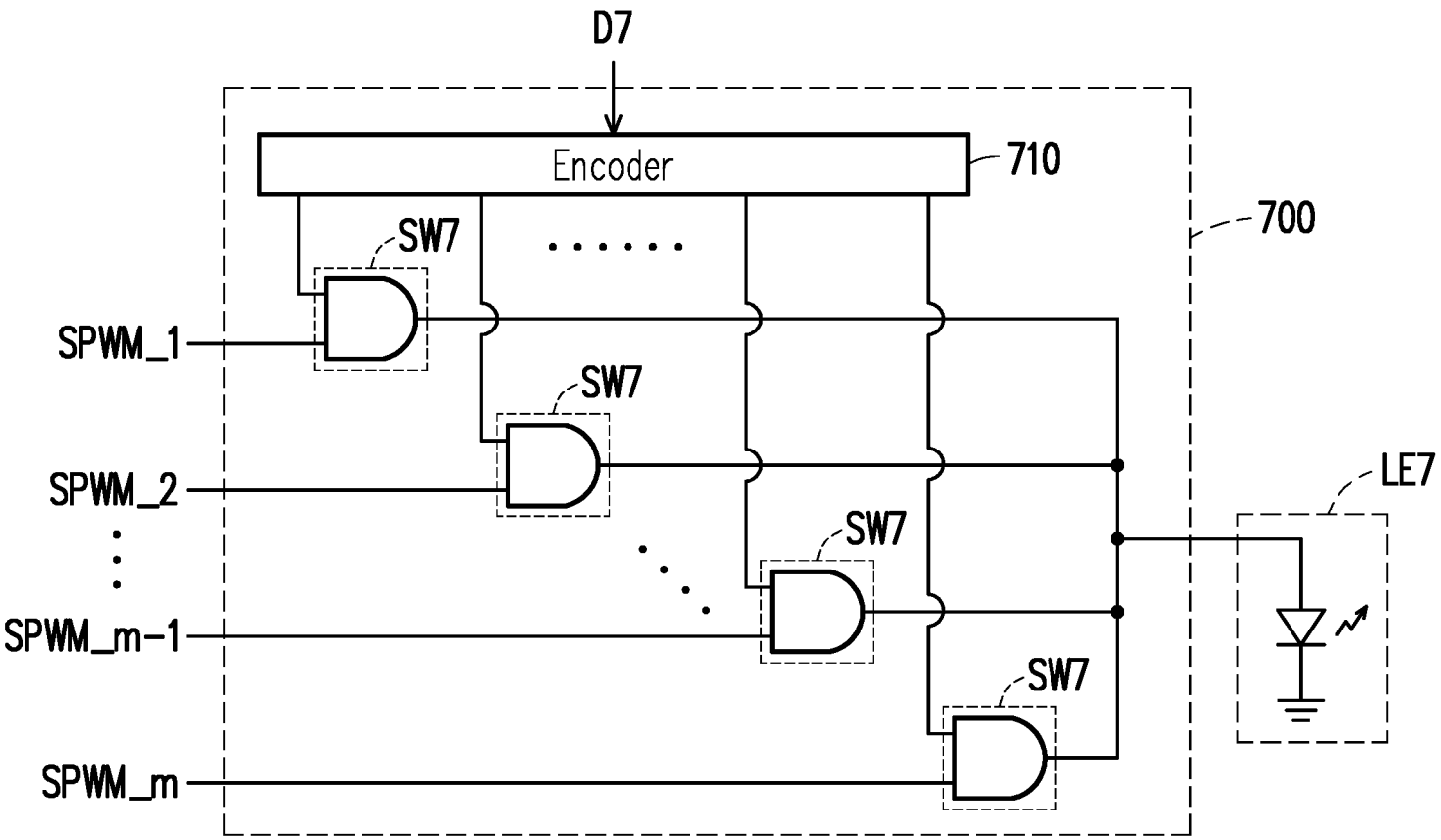
FIG. 7 is a schematic diagram of a circuit block of a PWM selection circuit according to another embodiment of the disclosure.

FIG. 7 is a schematic diagram of a circuit block of a PWM selection circuit 700 according to another embodiment of the disclosure. The PWM selection circuit 700 shown in FIG. 7 may be coupled to the PWM generating circuit 110 to receive the PWM signals SPWM_1, SPWM_2, . . . , SPWM_m−1, and SPWM_m. The PWM selection circuit 700 shown in FIG. 7 may serve as an implementation example of any one of the PWM selection circuits 121_1 to **121_*n* shown in FIG. 1. That is, any one of the PWM selection circuits 121_1 to 121_*n* shown in FIG. 1 may be deduced by referring to the related description of the PWM selection circuit 700 shown in FIG. 7, and/or for the PWM selection circuit 700 shown in FIG. 7, reference may be made to the related description of any one of the PWM selection circuits 121_1 to 121_*n* shown in FIG. 1. Sub-pixel data D7 shown in FIG. 7 may be regarded as any one of the sub-pixel data DATA1 to DATAn shown in FIG. 1**.

The PWM selection circuit 700 shown in FIG. 7 includes an encoder 710 and multiple switches SW7. An input terminal of the encoder 710 may receive the corresponding sub-pixel data D7. The encoder 710 may perform a one-hot encoding on the sub-pixel data D7 to generate a one-hot code to control the switches SW7, as shown in FIG. 7. Each of the switches SW7 is controlled by a corresponding bit in the one-hot code output by the encoder 710. Therefore, the switches SW7 may select a PWM signal from the PWM signals SPWM_1 to SPWM_m, and the switches SW7 output the selected PWM signal to the corresponding light emitting element LE7. The light emitting element LE7 shown in FIG. 7 may be regarded as any one of the light emitting elements LE11 to LE**1*n* shown in FIG. 1**.

Figure 8:
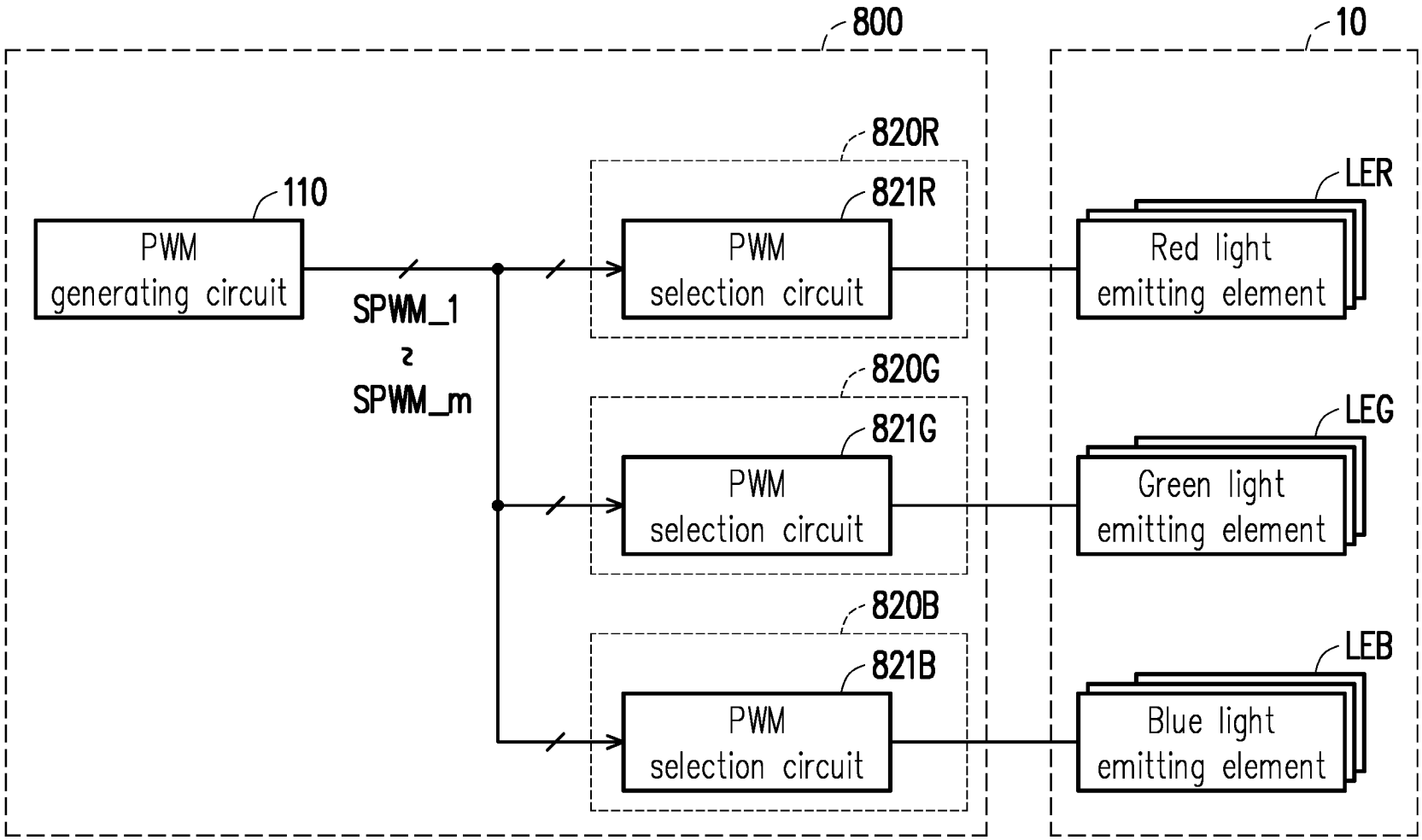
FIG. 8 is a schematic diagram of a circuit block of a PWM driver according to another embodiment of the disclosure.

In some embodiments, the light emitting elements with different colors of the light emitting element array 10 shown in FIG. 1 may share the same PWM generating circuit 110, as shown in FIG. 8. In some embodiments, the light emitting elements with different colors of the light emitting element array 10 shown in FIG. 1 may each use a dedicated PWM generating circuit 110, as shown in FIG. 9.

FIG. 8 is a schematic diagram of a circuit block of a PWM driver 800 according to another embodiment of the disclosure. The PWM driver 800 is suitable for driving multiple light emitting elements (for example, a red light emitting element LER, a green light emitting element LEG, and a blue light emitting element LEB shown in FIG. 8) of the light emitting element array 10. For the red light emitting element LER, the green light emitting element LEG, and the blue light emitting element LEB shown in FIG. 8, reference may be made to the related description of the light emitting elements LE11 to LE**1*n* shown in FIG. 1. The PWM driver 800 shown in FIG. 8 includes the PWM generating circuit 110 and multiple driving channels (for example, driving channels 820R, 820G, and 820B shown in FIG. 8). The driving channel 820R may drive the red light emitting element LER. The driving channel 820G may drive the green light emitting element LEG. The driving channel 820B may drive the blue light emitting element LEB. For the driving channels 820R, 820G, and 820B shown in FIG. 8, reference may be made to the related description of the driving channels 120_1 to 120_*n* shown in FIG. 1**.

The driving channel 820R includes a PWM selection circuit 821R. The driving channel 820G includes a PWM selection circuit 821G. The driving channel 820B includes a PWM selection circuit 821B. The PWM selection circuits 821R, 821G, and 821B are coupled to the PWM generating circuit 110 to receive the PWM signals SPWM_1 to SPWM_m. For the PWM generating circuit 110 and the PWM signals SPWM_1 to SPWM_m shown in FIG. 8, reference may be made to the related descriptions of the PWM generating circuit 110 and the PWM signals SPWM_1 to SPWM_m shown in FIG. 1, FIG. 3, FIG. 4, and/or FIG. 5. Each of the PWM selection circuits 821R, 821G, and 821B selects a PWM signal from the PWM signals SPWM_1 to SPWM_m according to corresponding sub-pixel data, and outputs the selected PWM signal to at least one corresponding light emitting element among the red light emitting element LER, the green light emitting element LEG, and the blue light emitting element LEB. For the PWM selection circuits 821R, 821G, and 821B shown in FIG. 8, reference may be made to the related description of the PWM selection circuits 121_1 to **121_*n* shown in FIG. 1. For the PWM selection circuits 821R, 821G, and 821B shown in FIG. 8, reference may also be made to the related description of the PWM selection circuit 600 shown in FIG. 6 or the PWM selection circuit 700 shown in FIG. 7**.

Figure 9:
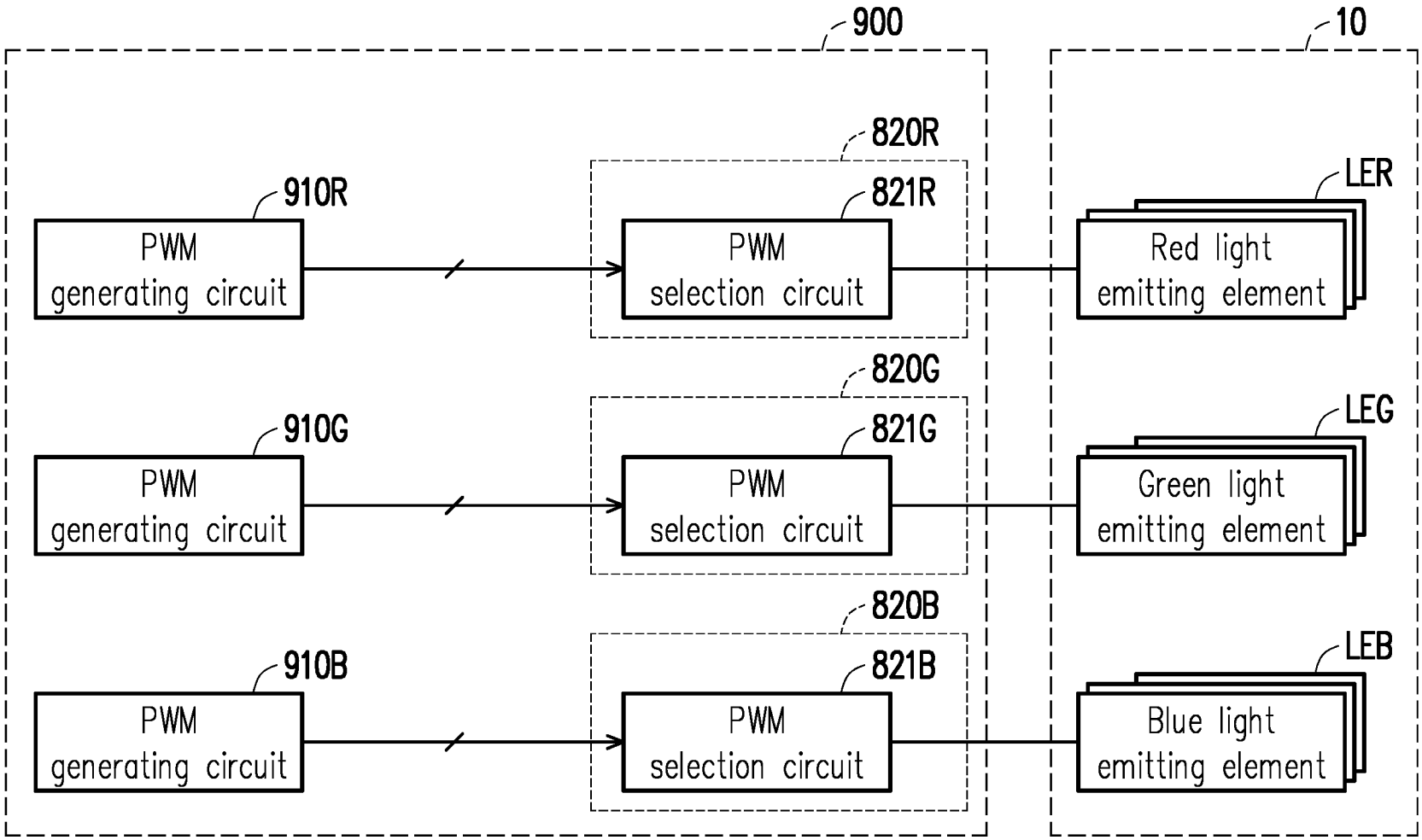
FIG. 9 is a schematic diagram of a circuit block of a PWM driver according to yet another embodiment of the disclosure.

FIG. 9 is a schematic diagram of a circuit block of a PWM driver 900 according to yet another embodiment of the disclosure. The PWM driver 900 is suitable for driving multiple light emitting elements (for example, the red light emitting element LER, the green light emitting element LEG, and the blue light emitting element LEB shown in FIG. 9) of the light emitting element array 10. For the red light emitting element LER, the green light emitting element LEG, and the blue light emitting element LEB shown in FIG. 9, reference may be made to the related description of the red light emitting element LER, the green light emitting element LEG, and the blue light emitting element LEB shown in FIG. 8. The PWM driver 900 shown in FIG. 9 includes multiple PWM generating circuits (for example, PWM generating circuits 910R, 910G, and 910B shown in FIG. 9) and multiple driving channels (for example, the driving channels 820R, 820G, and 820B shown in FIG. 9). For the driving channels 820R, 820G, and 820B shown in FIG. 9, reference may be made to the related description of the driving channels 820R, 820G, and 820B shown in FIG. 8.

The driving channel 820R shown in FIG. 9 includes the PWM selection circuit 821R. The driving channel 820G includes the PWM selection circuit 821G. The driving channel 820B includes the PWM selection circuit 821B. The PWM selection circuit 821R is coupled to the PWM generating circuit 910R to receive PWM signals. The PWM selection circuit 821G is coupled to the PWM generating circuit 910G to receive PWM signals. The PWM selection circuit 821B is coupled to the PWM generating circuit 910B to receive PWM signals. For each of the PWM generating circuits 910R, 910G, and 910B shown in FIG. 9, reference may be made to the related description of the PWM generating circuit 110 shown in FIG. 1, so the details will not be repeated.

The PWM selection circuit 821R shown in FIG. 9 selects a PWM signal from the PWM signals output by the PWM generating circuit 910R according to corresponding sub-pixel data, and outputs the selected PWM signal to the red light emitting element LER. The PWM selection circuit 821G selects a PWM signal from the PWM signals output by the PWM generating circuit 910G according to corresponding sub-pixel data, and outputs the selected PWM signal to the green light emitting element LEG. The PWM selection circuit 821B selects a PWM signal from the PWM signals output by the PWM generating circuit 910B according to corresponding sub-pixel data, and outputs the selected PWM signal to the blue light emitting element LEB. For the PWM selection circuits 821R, 821G, and 821B shown in FIG. 9, reference may be made to the related description of the PWM selection circuits 821R, 821G, and 821B shown in FIG. 8. For the PWM selection circuits 821R, 821G, and 821B shown in FIG. 9, reference may also be made to the related description of the PWM selection circuit 600 shown in FIG. 6 or the PWM selection circuit 700 shown in FIG. 7.

Although the disclosure has been disclosed in the above embodiments, the above embodiments are not intended to limit the disclosure. Persons skilled in the art may make some changes and modifications without departing from the spirit and scope of the disclosure. Therefore, the protection scope of the disclosure shall be defined by the scope of the appended claims.

What is claimed is:

1. A pulse width modulation (PWM) driver, comprising:

a PWM generating circuit, configured to generate a plurality of PWM signals, wherein the PWM generating circuit determines a pulse width and a phase of each of the PWM signals; and a plurality of first driving channels, configured to drive a plurality of first light emitting elements of a light emitting element array, wherein each of the first driving channels comprises a first PWM selection circuit, the first PWM selection circuits are coupled to the PWM generating circuit to receive the PWM signals, each of the first PWM selection circuits selects a first selected PWM signal from the PWM signals according to corresponding sub-pixel data, and the first selected PWM signal is output to at least one corresponding light emitting element among the first light emitting elements.

2. The PWM driver according to claim 1, wherein the PWM signals have different pulse widths.

3. The PWM driver according to claim 1, wherein the PWM signals have different phases.

4. The PWM driver according to claim 1, further comprising:

a second driving channel, configured to drive a plurality of second light emitting elements of the light emitting element array, wherein a color of the second light emitting elements is different from a color of the first light emitting elements, the second driving channel comprises a second PWM selection circuit, the second PWM selection circuit is coupled to the PWM generating circuit to receive the PWM signals, the second PWM selection circuit selects a second selected PWM signal from the PWM signals according to corresponding sub-pixel data, and the second selected PWM signal is output to at least one corresponding light emitting element among the second light emitting elements.

5. The PWM driver according to claim 1, wherein any one at least one of the first PWM selection circuits comprises:

a plurality of multiplexers, wherein the multiplexers are controlled by the corresponding sub-pixel data to select the first selected PWM signal from the PWM signals, and the multiplexers output the first selected PWM signal to the at least one corresponding light emitting element among the first light emitting elements.

6. The PWM driver according to claim 1, wherein at least one of the first PWM selection circuits comprises:

an encoder, having an input terminal for receiving the corresponding sub-pixel data and configured to perform a one-hot encoding on the corresponding sub-pixel data to generate a one-hot code; and a plurality of switches, wherein each of the switches is controlled by a corresponding bit in the one-hot code, the switches select the first selected PWM signal from the PWM signals, and the switches output the first selected PWM signal to the at least one corresponding light emitting element among the first light emitting elements.

7. A pulse width modulation (PWM) driver, comprising:

a first PWM generating circuit, configured to generate a plurality of first PWM signals, wherein the first PWM generating circuit determines a pulse width and a phase of each of the first PWM signals;

a first driving channel, configured to drive a plurality of first light emitting elements of a light emitting element array, wherein the first driving channel comprises a first PWM selection circuit, the first PWM selection circuit is coupled to the first PWM generating circuit to receive the first PWM signals, the first PWM selection circuit selects a first selected PWM signal from the first PWM signals according to corresponding sub-pixel data, and the first selected PWM signal is output to at least one corresponding light emitting element among the first light emitting elements;

a second PWM generating circuit, configured to generate a plurality of second PWM signals, wherein the second PWM generating circuit determines a pulse width and a phase of each of the second PWM signals; and a second driving channel, configured to drive a plurality of second light emitting elements of the light emitting element array, wherein a color of the second light emitting elements is different from a color of the first light emitting elements, the second driving channel comprises a second PWM selection circuit, the second PWM selection circuit is coupled to the second PWM generating circuit to receive the second PWM signals, the second PWM selection circuit selects a second selected PWM signal from the second PWM signals according to corresponding sub-pixel data, and the second selected PWM signal is output to at least one corresponding light emitting element among the second light emitting elements.

8. The PWM driver according to claim 7, wherein the second PWM signals have different pulse widths.

9. The PWM driver according to claim 7, wherein the second PWM signals have different phases.

10. An operation method of a PWM driver, comprising:

generating, by a PWM generating circuit, a plurality of PWM signals, wherein the PWM generating circuit determines a pulse width and a phase of each of the PWM signals; and selecting, by a first PWM selection circuit of each of a plurality of first driving channels, a first selected PWM signal from the PWM signals according to corresponding sub-pixel data, wherein the first selected PWM signal is output to at least one corresponding light emitting element among a plurality of first light emitting elements of a light emitting element array, so that the first driving channels drive the first light emitting elements of the light emitting element array.

11. The operation method according to claim 10, wherein the PWM signals have different pulse widths.

12. The operation method according to claim 10, wherein the PWM signals have different phases.

13. The operation method according to claim 10, further comprising:

selecting, by a plurality of multiplexers controlled by the corresponding sub-pixel data, the first selected PWM signal from the PWM signals; and outputting, by the multiplexers, the first selected PWM signal to the at least one corresponding light emitting element among the first light emitting elements.

14. The operation method according to claim 10, further comprising:

performing, by an encoder, a one-hot encoding on the corresponding sub-pixel data to generate a one-hot code;

selecting, by a plurality of switches controlled by the one-hot code, the first selected PWM signal from the PWM signals; and outputting, by the switches, the first selected PWM signal to the at least one corresponding light emitting element among the first light emitting elements.

* * * * *